US009578971B2

(12) United States Patent
Su

(10) Patent No.: US 9,578,971 B2
(45) Date of Patent: Feb. 28, 2017

(54) ARMREST INTERVAL ADJUSTMENT STRUCTURE FOR A CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 57 days.

(21) Appl. No.: 14/816,008

(22) Filed: Aug. 2, 2015

(65) Prior Publication Data

US 2017/0027329 A1 Feb. 2, 2017

(51) Int. Cl.
*A47C 7/54* (2006.01)

(52) U.S. Cl.
CPC ..... *A47C 7/54* (2013.01)

(58) Field of Classification Search
CPC ..... A47C 7/54
USPC ..... 297/411.37
See application file for complete search history.

(56) References Cited

U.S. PATENT DOCUMENTS 1,955,969 A * 4/1934 Marzolf ..... F16B 7/105 292/143
4,536,031 A * 8/1985 Latone ..... A47C 7/40 297/383 X
5,035,466 A * 7/1991 Mathews ..... A47C 1/023 297/337 X
5,338,133 A * 8/1994 Tornero ..... A47C 1/03 297/411.37 X
5,462,338 A * 10/1995 Baumann ..... A47C 1/03 297/411.37 X
5,511,852 A * 4/1996 Kusiak ..... A47C 1/023 297/383 X
5,615,926 A * 4/1997 Kanai ..... A47C 7/546 297/411.2
5,660,442 A * 8/1997 Tornero ..... A47C 1/03 297/411.37 X
5,839,784 A * 11/1998 Breen ..... A47C 1/03 297/411.37 X
5,944,387 A * 8/1999 Stumpf ..... A47C 1/03 297/411.37 X
6,076,891 A * 6/2000 Bernhardt ..... A47C 1/03 297/411.37 X
6,409,266 B1 * 6/2002 Chen ..... A47C 31/11 297/218.3
6,572,195 B1 * 6/2003 Lee ..... A47C 1/03 297/411.37 X
6,619,745 B2 * 9/2003 Roberts ..... A47C 7/42 297/383

(Continued)

*Primary Examiner* — Rodney B White

(57) ABSTRACT

A mechanism fixed under a cushion for adjusting an interval of two armrests is disclosed. The invention includes a base, an armrest support and a handle set. The base is a hollow body with a channel and has an elastic block with a central through hole. The armrest support has a connecting section slidably penetrating the channel. The connecting section is formed with a longitudinal through hole corresponding to the central through hole in position. The handle set is fixed under the base and includes a handle with a fixing bar and an opening; a presser received in the opening and has a fixing hole corresponding to the central through hole in position and an engagement trench for engaging with the fixing bar; and a bolt passing through the fixing hole, longitudinal hole and central through hole, and screwed with a nut to fasten the handle to the base.

6 Claims, 7 Drawing Sheets

(56) References Cited

U.S. PATENT DOCUMENTS

| | | | | |
|---|---|---|---|---|
| 6,659,560 | B1 * | 12/2003 | Chi | A47C 1/023 297/411.37 X |
| 7,243,997 | B1 * | 7/2007 | Tornero | A47C 1/03 297/411.37 X |
| 7,527,335 | B2 * | 5/2009 | Eberlein | A47C 1/03 297/218.1 |
| 7,806,481 | B2 * | 10/2010 | Eberlein | A47C 1/03 297/411.37 X |
| 8,104,838 | B2 * | 1/2012 | Tsai | A47C 1/03 297/411.37 X |
| 8,449,035 | B2 * | 5/2013 | Breitkreuz | A47C 7/42 297/411.37 X |
| 8,459,746 | B2 * | 6/2013 | Lai | A47C 1/03 297/411.37 X |
| 2010/0123346 | A1 * | 5/2010 | Lin | A47C 1/03 297/411.37 |

* cited by examiner

ARMREST INTERVAL ADJUSTMENT STRUCTURE FOR A CHAIR

BACKGROUND OF THE INVENTION

1. Technical Field

The invention relates to chairs, particularly to armrests of chairs.

2. Related Art

Office chairs with an elevation mechanism and/or flexible back have been very popular. However, armrests of few chairs provide an adjustment mechanism. Even if an adjustment mechanism is provided to armrests of a chair, it offers a single function of height adjustment. In fact, an armrest interval adjustment mechanism is needed by some users. However, there is no chair with an armrest interval adjustment mechanism in the market. Complexity, adjustability and reliability are very difficult to achieve a compromise.

SUMMARY OF THE INVENTION

An object of the invention is to provide an armrest interval adjustment structure for a chair, which can offer an armrest to be horizontally adjustable. Thus seat width can be adjusted.

To accomplish the above object, the armrest interval adjustment structure of the invention includes a base, an armrest support and a handle set. The base is a hollow body with a channel and has an elastic block with a central through hole. The armrest support has a connecting section slidably penetrating the channel. The connecting section is formed with a longitudinal through hole corresponding to the central through hole in position. The handle set is fixed under the base and includes a handle with a fixing bar and an opening; a presser received in the opening and has a fixing hole corresponding to the central through hole in position and an engagement trench for engaging with the fixing bar; and a bolt passing through the fixing hole, longitudinal hole and central through hole, and screwed with a nut to fasten the handle to the base.

DETAILED DESCRIPTION OF THE INVENTION

Figure 1:
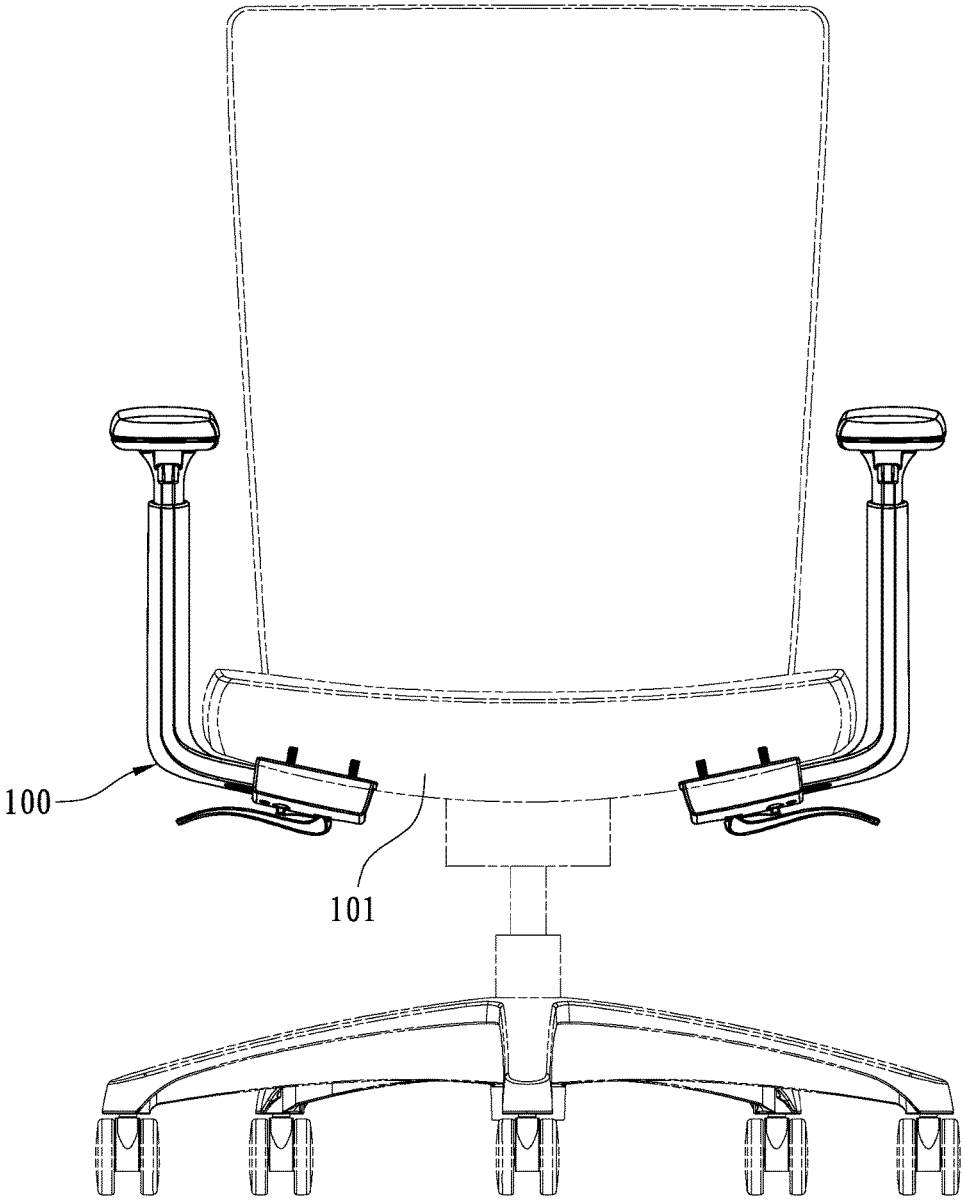
FIG. 1 is a schematic view of the invention used in a chair.
Figure 2:
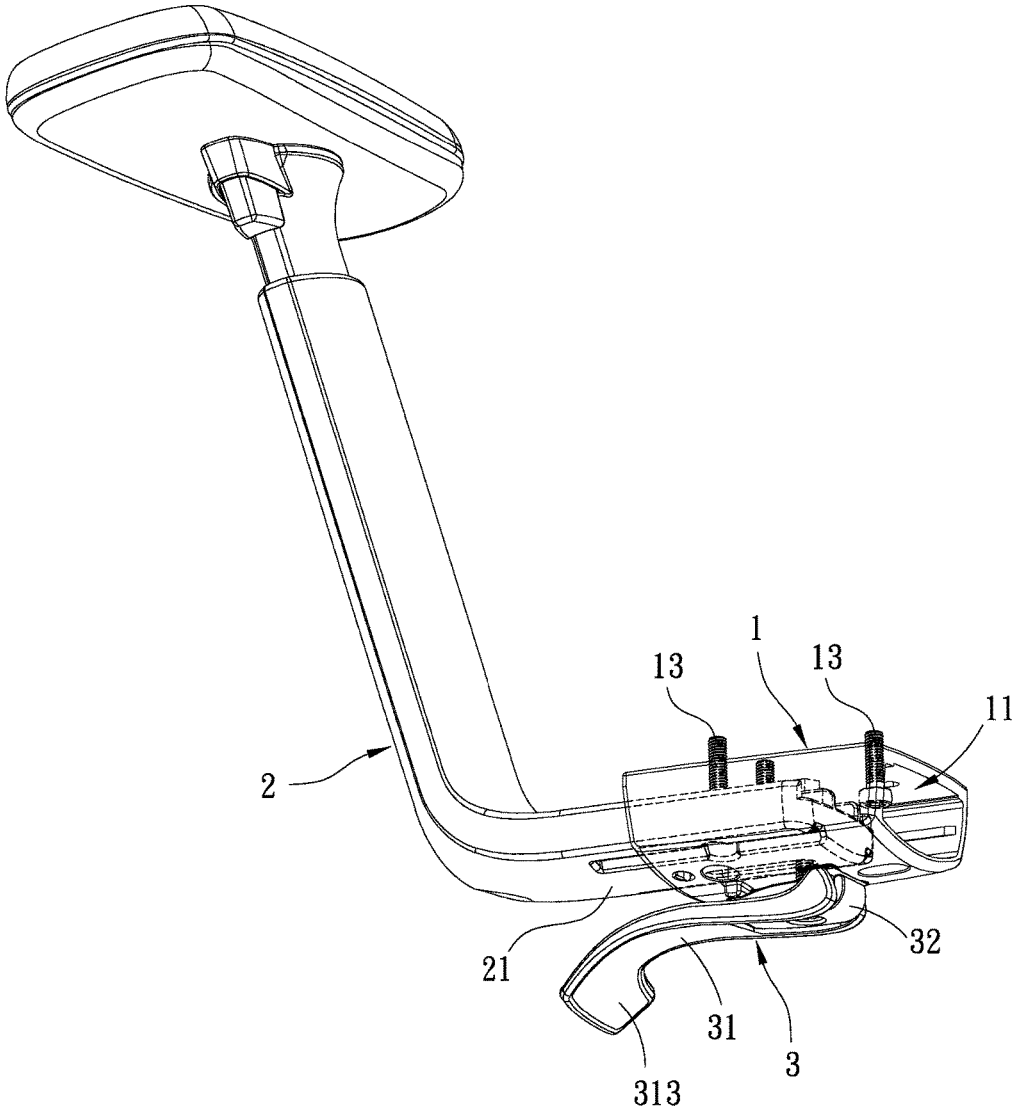
FIG. 2 is a perspective view of the invention.
Figure 3:
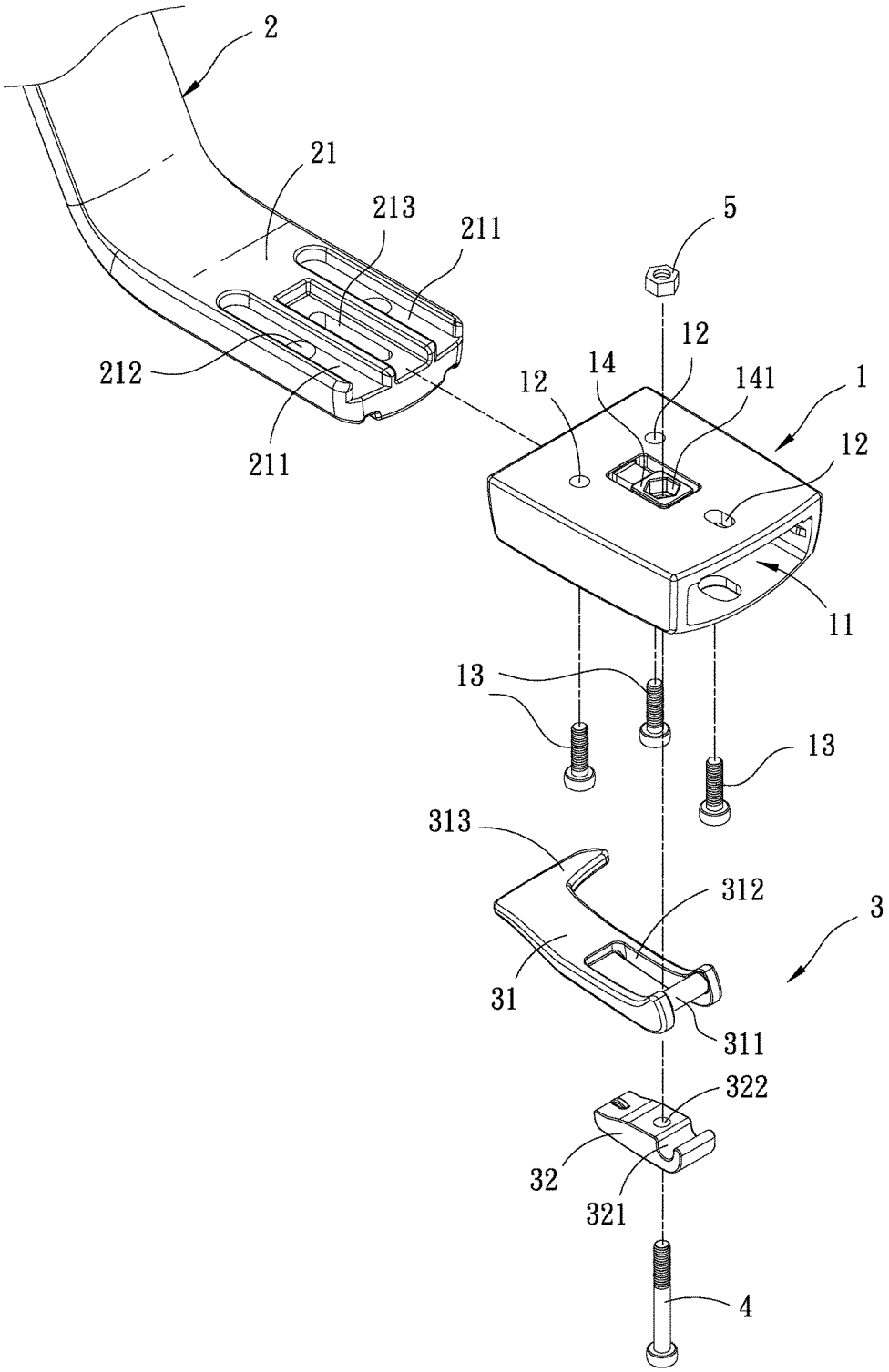
FIG. 3 is an exploded view of the invention.
Figure 4:
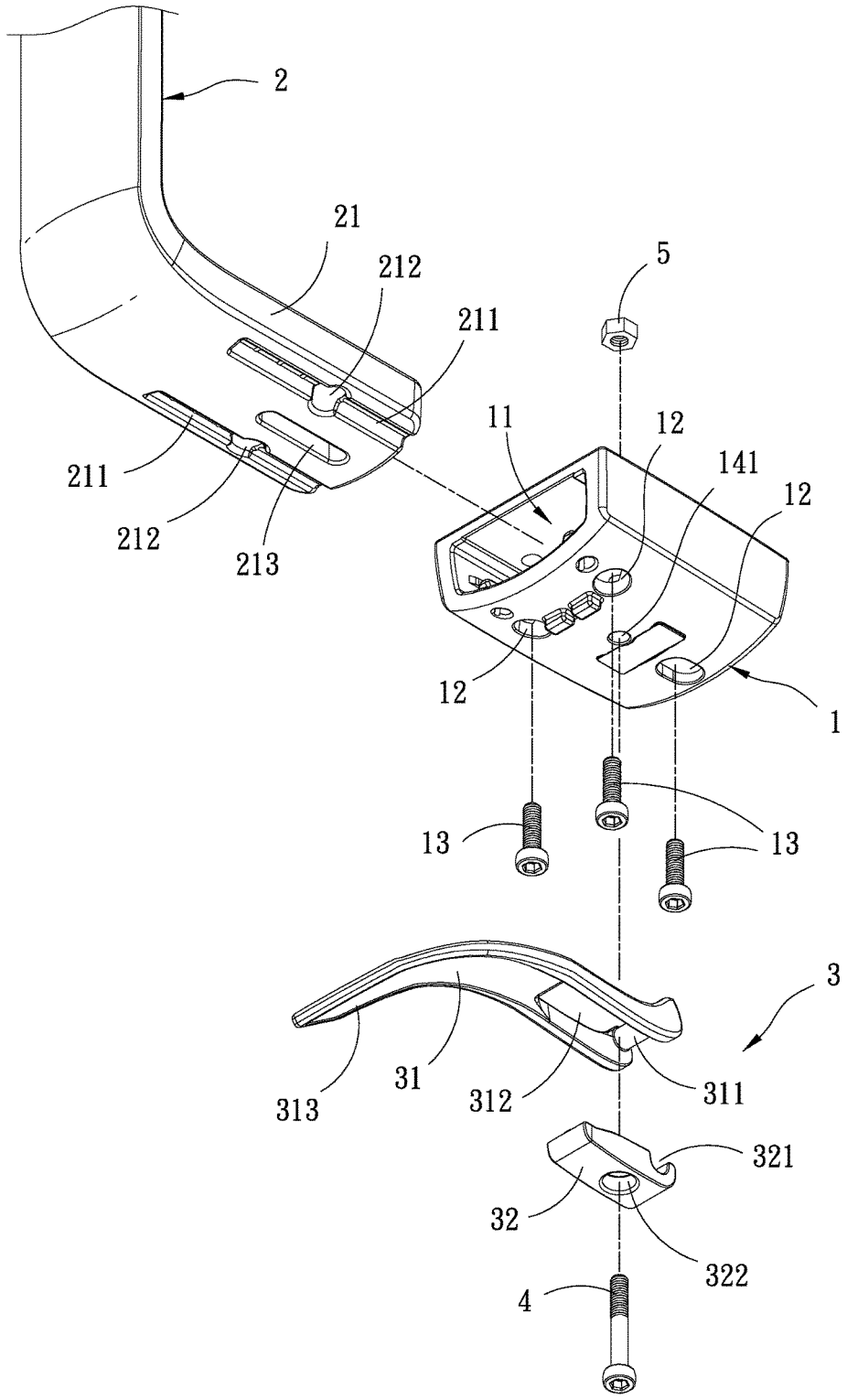
FIG. 4 is another exploded view of the invention.
Figure 5:
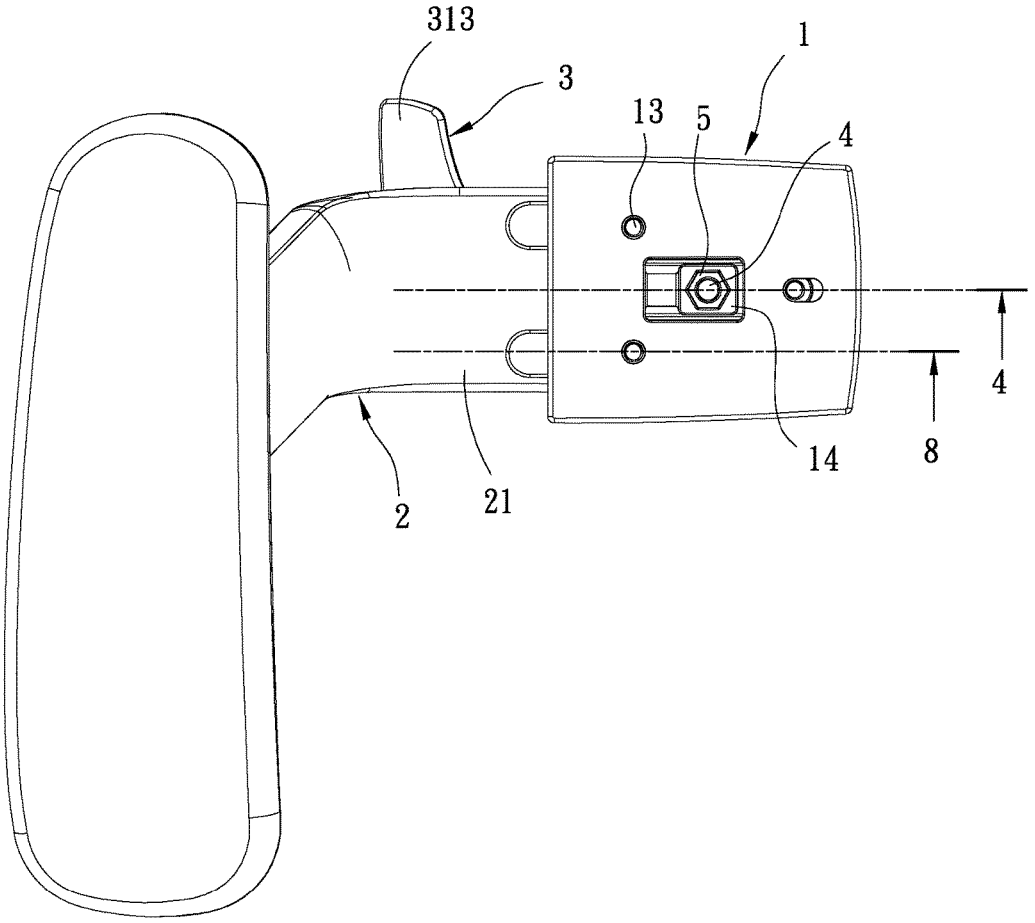
FIG. 5 is a top plan view of the invention.
Figure 6:
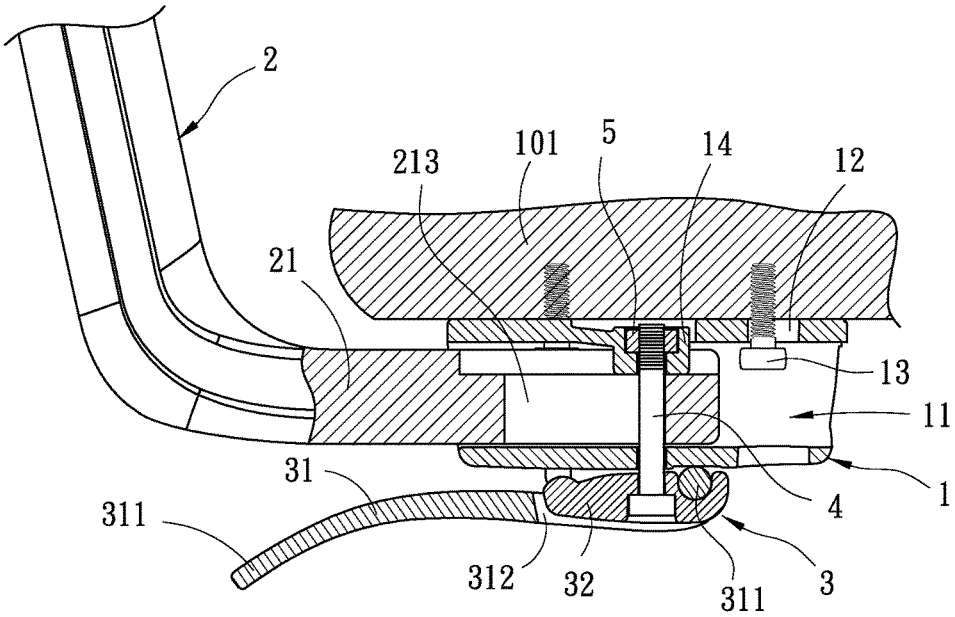
FIGS. 6-9 are four cross-sectional views of the invention in different statuses of operation.

Please refer to FIG. 1. A pair of the armrest interval adjustment structures of the invention is installed under a cushion 101 of a chair 100 and includes a base 1, an armrest support 2 and a handle set 3. As shown in FIGS. 2-4, the base 1 is fastened to the bottom of the cushion 101. The base 1 is a hollow body with a channel 11 and is provided with passing holes 12 for being separately passed by screws 13. The base 1 is fastened to the cushion 101 by the screws 13. An upper side of the base 1 is formed with an elastic block 14 with a central through hole 141 abutting against the cushion 101.

The armrest support 2 is connected to the base 1. The armrest support 2 has a connecting section 21 penetrating the channel 11. An upper side and a lower side of the connecting section 21 are separately formed with two troughs 211. Each of the troughs 211 is formed with a round through hole 212. The connecting section is formed with a longitudinal through hole 213 between the two troughs 211. The longitudinal hole 213 corresponds to the central through hole 141 in position The handle set 3 is fastened onto the bottom of the base 1. The handle set 3 includes a handle 31 and a presser 32. An end of the handle 31 is formed with a fixing bar 311. The handle 31 is further formed with an opening 312. The other end of the handle 31 is a handling end 313. In this embodiment, the handling end 313 is of an L-shape. The presser 32 is assembled with the handle 31 and is formed with an engagement trench 321. The presser 32 is received in the opening 312 with engaging the engagement trench 321 onto the fixing bar 311 so as to make the handle 31 rotatable. The presser 32 is formed with a fixing hole 322 corresponding to the central through hole 411 in position.

A bolt 4 passes through the fixing hole 322, the longitudinal hole 213 and the central through hole 141 and is screwed with a nut 5 to fasten the handle set 3 to the base 1. The elastic block 14 is pressed by the connecting section 21 by means of tightening the bolt 4 and the nut 5.

Figure 7:
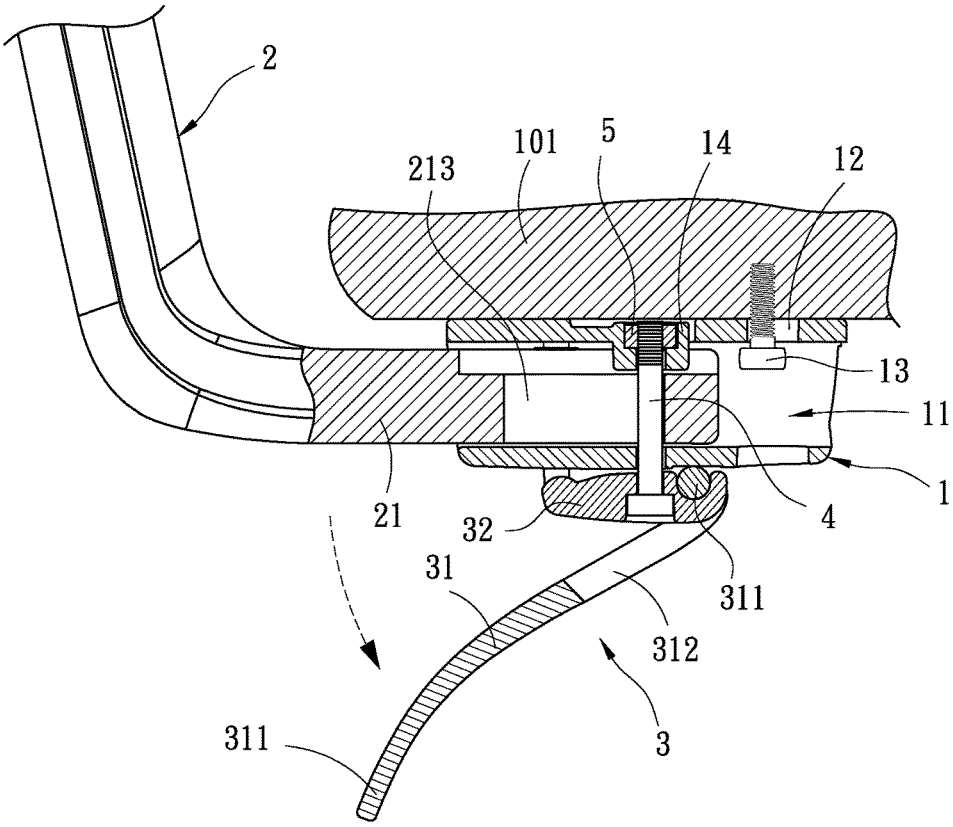
Figure 8:
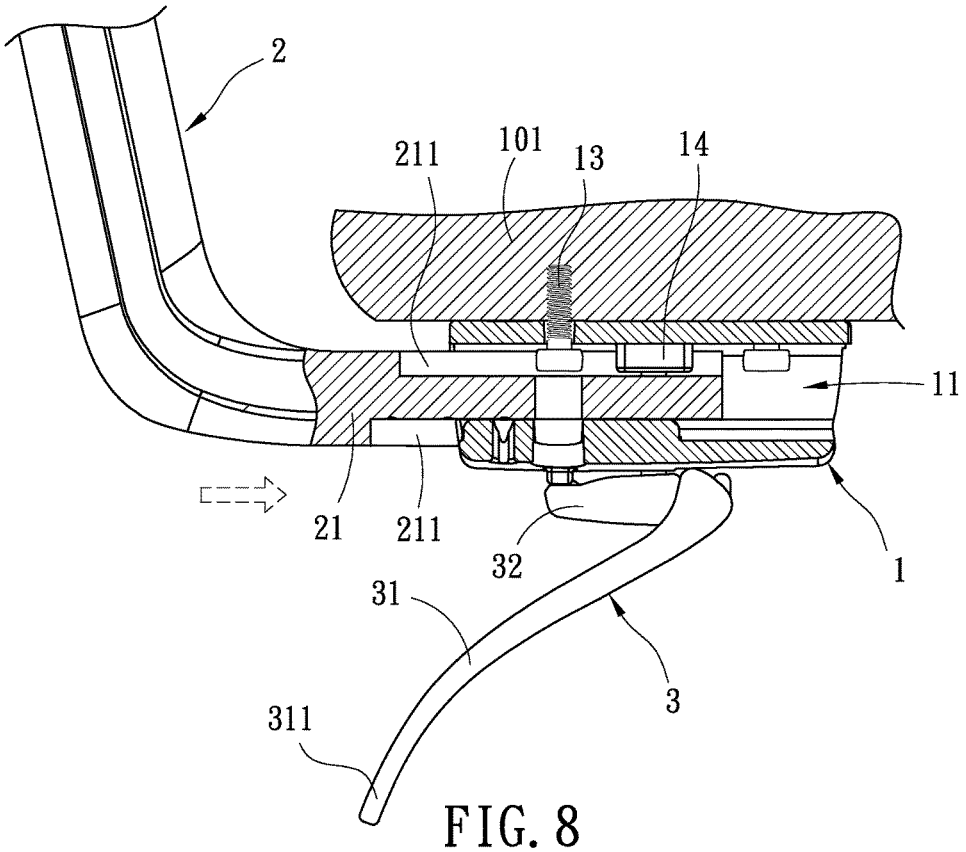
Figure 9:
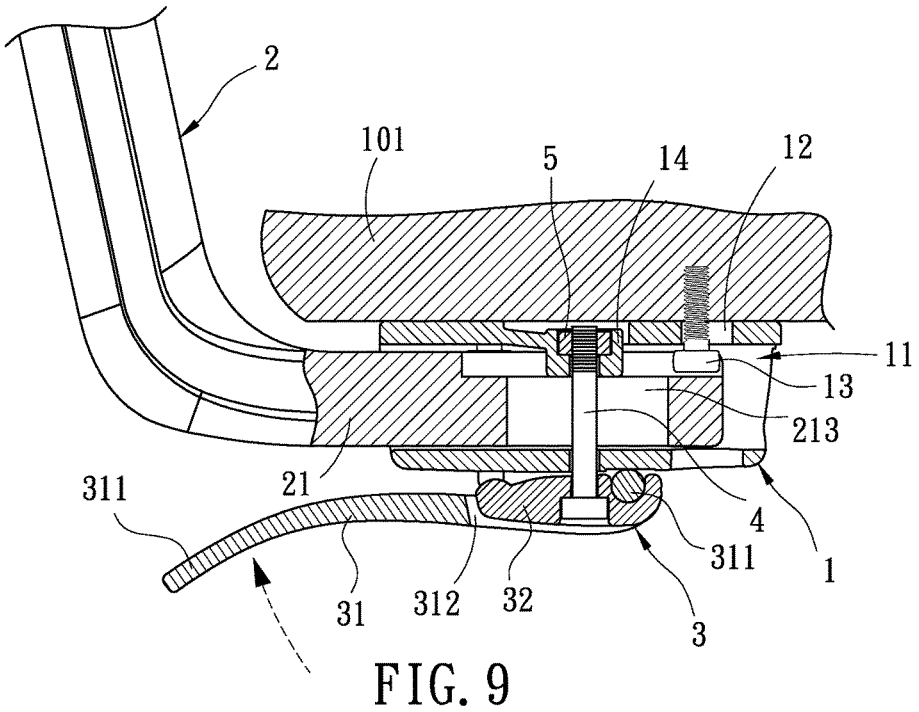

Please refer to FIGS. 6-9. When the interval between the two armrests needs to be adjusted, pull the handling end 313 downward as shown in FIG. 7. Then the handle 31 applies pressure to the bolt 4 to make the elastic block raised and the connecting section 21 escapes from the elastic block 14 as shown in FIG. 8. After that, the armrest support 2 can be horizontally moved. When the armrest support 2 has been moved to a desired position, press the handle 31 to restore the elastic block 14. Thus the connecting section 21 can be positioned again.

It will be appreciated by persons skilled in the art that the above embodiment has been described by way of example only and not in any limitative sense, and that various alterations and modifications are possible without departure from the scope of the invention as defined by the appended claims.

What is claimed is:

1. An armrest interval adjustment structure for a chair, comprising:

a base, being a hollow body with a channel, having an elastic block with a central through hole;

an armrest support for supporting an armrest, the armrest support having a connecting section slidably penetrating the channel, and the connecting section being formed with a longitudinal through hole corresponding to the central through hole of the elastic block; and a handle assembly fixed under the base, the handle assembly comprising:

a handle having a first end thereof being formed with a fixing bar, the fixing bar having an opening;

a presser received in the opening, the presser having a fixing hole corresponding to the central through hole of the elastic block and an engagement trench for engaging with the fixing bar so as to make the handle pivotable; and a bolt passing through the fixing hole of the presser, the longitudinal hole of the connection section, the central through hole of the elastic block, and a threaded end of the bolt screwed by a nut to fasten the handle to the base;

wherein the elastic block is pressed by the connecting section by means of tightening the bolt and the nut.

2. The armrest interval adjustment structure of claim 1, wherein an upper side and a lower side of the connecting section are separately formed with two troughs, each of the troughs formed with a round through hole.

3. The armrest interval adjustment structure of claim 1, wherein a second end of the handle is a gripping end, the gripping end adapted for being gripped by a user to pivot the handle downward to allow adjustment of a lateral position of the armrest with respect to a seat cushion of the chair.

4. The armrest interval adjustment structure of claim 3, wherein the gripping end of the handle is L-shaped.

5. The armrest interval adjustment structure of claim 1, wherein the base is provided with holes for receiving screws to fasten the base to the chair.

6. The armrest interval adjustment structure of claim 1, wherein the elastic block abuts against the connecting section of the armrest support.

* * * * *